US006173581B1

(12) United States Patent
Wyatt

(10) Patent No.: US 6,173,581 B1
(45) Date of Patent: Jan. 16, 2001

(54) LIQUID COOLER

(76) Inventor: Lance Ronald Wyatt, 131 Branksome Towers, 172 Musgrave Road, Durban, 4001 (ZA)

( * ) Notice: Under 35 U.S.C. 154(b), the term of this patent shall be extended for 0 days.

(21) Appl. No.: 09/412,750

(22) Filed: Oct. 5, 1999

Related U.S. Application Data

(63) Continuation of application No. 09/061,045, filed on Apr. 16, 1998.

(51) Int. Cl.[7] ..... F25D 3/08
(52) U.S. Cl. ..... 62/457.3; 62/530
(58) Field of Search ..... 62/457.3, 457.2, 62/457.4, 530

(56) References Cited

U.S. PATENT DOCUMENTS 4,383,422 * 5/1983 Gordon et al. ..... 62/457.4
5,212,963 * 5/1993 McGinnis ..... 62/457.4
5,653,124 * 8/1997 Weber ..... 62/457.4

* cited by examiner

*Primary Examiner*—William Doerrler
(74) *Attorney, Agent, or Firm*—Burns, Doane, Swecker & Mathis, L.L.P.

(57) ABSTRACT

A liquid cooler comprising an elongate cylindrical container for holding a liquid to be cooled, and a buoyant cylindrical stainless steel cartridge containing a refrigerant, that is located in the container. The container is open-topped and is closeable via a dome-shaped moulded polyethylene lid having a spout. The container has a surrounding wall comprising an inner wall section of stainless steel having a relatively high thermal conductivity and an outer wall section. The outer wall section comprises a number of layers of material having relatively high thermal insulation properties. The cartridge has an air pocket trapped therein to provide buoyancy therefor which causes the cartridge to rise, in use, within the container. As such, the container and the cartridge define a space between them along which relative flow of liquid occurs when the cartridge rises within the container, thereby enhancing cooling of the liquid.

9 Claims, 2 Drawing Sheets

LIQUID COOLER

This application is a continuation of application Ser. No. 09/061,045, filed Apr. 16, 1998.

SUMMARY OF THE INVENTION

This invention relates to a liquid cooler.

According to the invention, there is provided a liquid cooler comprising a container comprising at least one surrounding wall of a material having relatively high thermal insulation characteristics, the surrounding wall defining an internal compartment for holding a liquid to be cooled and having an opening through which the liquid can be introduced into and removed from the internal compartment; and a cartridge comprising at least one surrounding wall defining an internal compartment for holding a relatively cool substance, the surrounding wall of the cartridge being of a material having a relatively high thermal conductivity and having dimensions and a configuration that permits it to be accommodated in the container.

The cartridge may be buoyant, thereby permitting it to rise, in use, within the container when liquid to be cooled is contained therein, thereby increasing the rate at which the liquid is cooled.

The container may have an elongate configuration having two ends, with the surrounding wall thereof including a base wall at one end of the container and at least one side wall, the cartridge and the side wall of the container defining a space between them along which relative flow of a liquid to be cooled, occurs when the cartridge rises within the container, in use.

The space defined between the cartridge and the side wall of the container may be sufficiently small to restrict the flow of liquid through the space and the buoyancy of the cartridge a predetermined amount, so as to cause the cartridge to rise within the container over an extended period of time.

In use, the size of the space defined between the cartridge and the side wall of the container, together with the buoyancy of the cartridge, combine to cause the cartridge to rise within the container over an extended period of time, thereby more effectively cooling liquid in the container as it flows through the space when the cartridge rises in the container.

The space defined between the cartridge and the side wall of the container when the cartridge rises, in use, within the container, may be approximately 1 mm.

The cartridge may have air captured therein to provide buoyancy therefor.

The surrounding wall of the container may comprise an outer wall section of a material having relatively high thermal insulation characteristics and an inner wall section of a material having a relatively high thermal conductivity.

The opening of the container may be releasably closeable by means of a closure that forms a fluid-tight seal with the container, in a closed condition of the closure.

The cartridge and the inner wall section of the surrounding wall of the container may be of a stainless steel.

BRIEF DESCRIPTION OF THE DRAWINGS

Further features of a liquid cooler in accordance with the invention, are described hereinafter by way of a non-limiting example of the invention with reference to and as illustrated in the accompanying diagrammatic drawings. In the drawings.

DESCRIPTION OF THE PREFERRED EMBODIMENT

Figure 1:
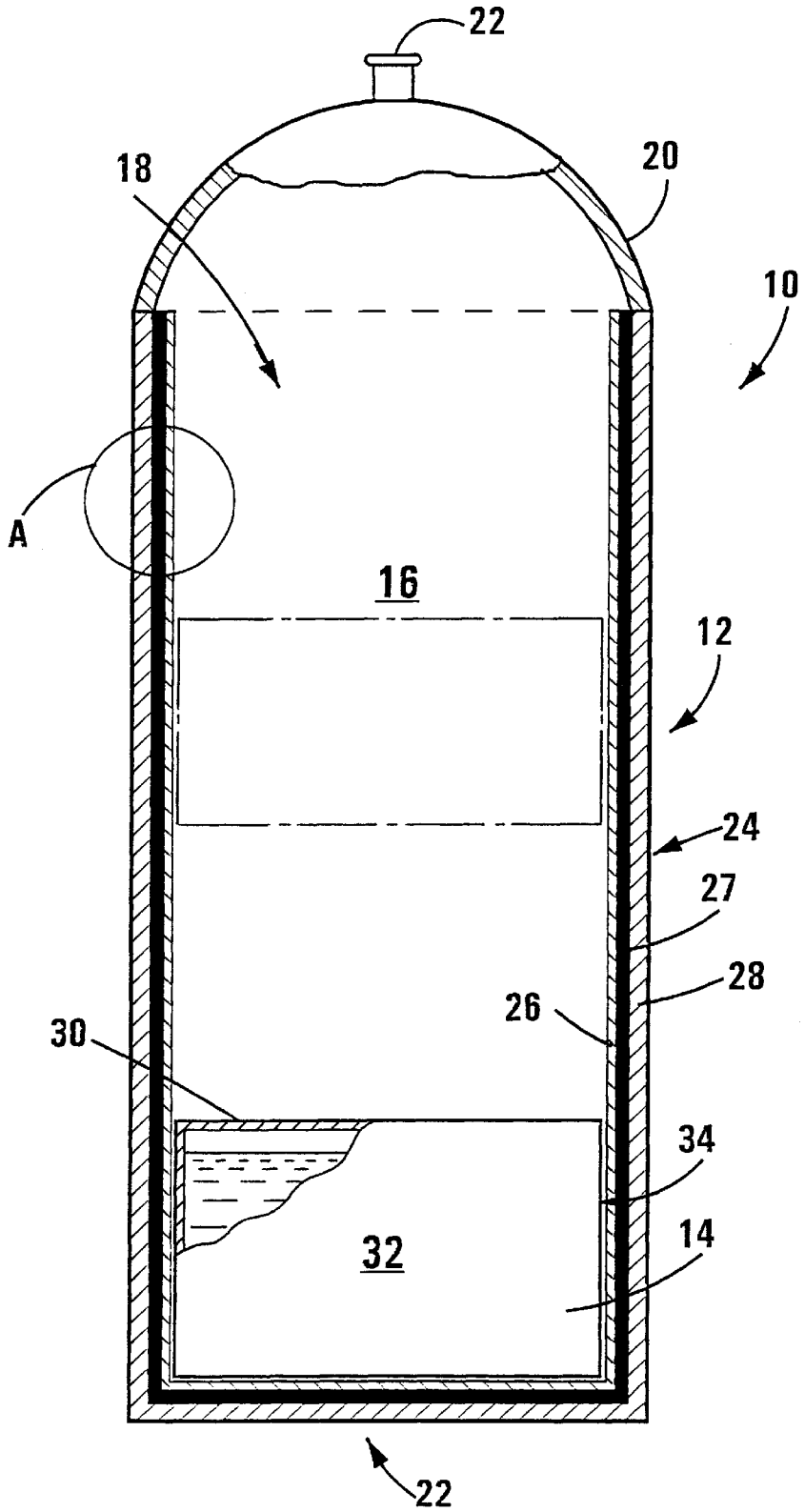
FIG. 1 shows a sectional side view of a liquid cooler in accordance with the invention.
Figure 2:
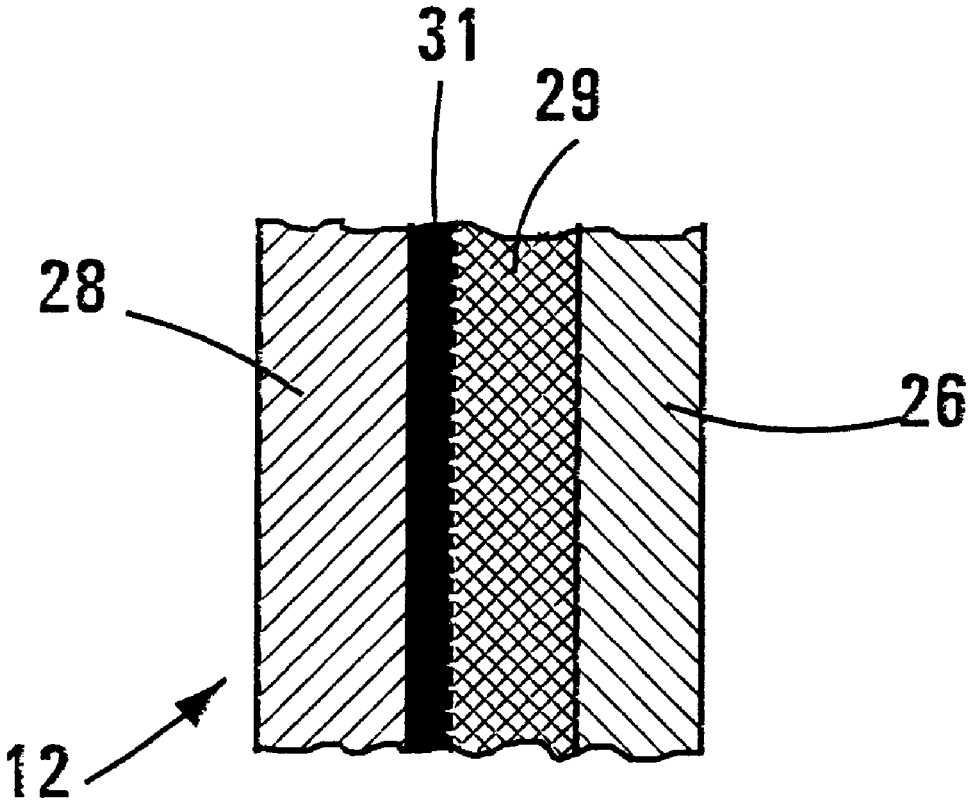
FIG. 2 shows an enlarged fragmentary sectional view of detail A of the liquid cooler of FIG. 1.

With reference to the drawing, a liquid cooler in accordance with the invention, is designated generally by the reference numeral 10. The liquid cooler 10 comprises, broadly, an elongate cylindrical container 12 for holding a liquid to be cooled and a buoyant cylindrical cartridge 14 containing a refrigerant that is accommodated in the container.

The container 12 comprises a surrounding wall defining an internal compartment 16 for holding a liquid to be cooled. The container 12 is open-topped and, as such, the surrounding wall thereof has an opening 18 that is closeable by means of a dome-shaped moulded polyethylene lid 20 that is releasably secured on the container to form a fluid-fight seal therewith. The lid 20 defines a closeable spout 22 through which liquid can be removed from the container 12. The container 12 can be filled by merely removing the lid 20 and filling the internal compartment 16 via the opening 18. As such, the lid 20 is hingedly secured to the container 12 in an arrangement wherein the lid can be hingedly displaced between an open condition wherein the container 12 can be filled with liquid and closed condition wherein the lid forms a fluid-tight seal with the container.

The surrounding wall of the container 12 includes a base wall 22 and a side wall 24 extending therefrom. The surrounding wall of the container comprises an inner wall section 26 of a stainless steel having a relatively high thermal conductivity and an outer wall section in the form of a cylindrical sleeve that is fitted over the inner wall section 26 of the container. The outer wall section comprises an outer layer 28 of high density moulded polyethylene, an inner layer 29 of expanded polyethylene having high thermal insulation characteristics and an intermediate layer 31 of metal foil marketed commercially in South Africa under the name "petfoil". The intermediate layer 31 also has high thermal insulation characteristics, thereby enhancing the thermal insulation of the container 12. The cartridge 14 has a hollow cylindrical configuration and comprises a surrounding wall 30 of a stainless steel having a relatively high thermal conductivity. The surrounding wall 30 of the cartridge 14 defines an internal compartment 32 for holding the refrigerant. It is envisaged by the Applicant that in order to cool the refrigerant in the cartridge, the cartridge may merely be located in a relatively cool environment, for example, such as the environment provided by a conventional domestic freezer and the like, prior to being located within the container 12 for cooling a liquid contained therein.

The cartridge 14 has an air pocket trapped therein to provide buoyancy therefor. The buoyancy of the cartridge causes it to rise, in use, within the container 12 when a liquid to be cooled is held therein, to thereby enhance the cooling effect on the liquid. As such, the surrounding wall 30 of the cartridge 14 and the inner wall section 26 of the container 12 define a space between them in the form of an annular 1 mm gap 34 along which relative flow of the liquid occurs when the cartridge rises within the container, in use. The Applicant has found that the gap 34 is sufficiently small to restrict the relative flow of liquid through the gap and the buoyancy of the cartridge being so as to cause the cartridge to gradually rise within the container over an extended period of time. The relative flow of liquid through the gap 34 as the cartridge rises within the container 12 over an extended period of time, allows for more effective heat transfer to take place between the liquid to be cooled and the refrigerant in the cartridge 14. The Applicant has found that a time of approximately 3 minutes for the cartridge to rise within the container, will provide the desired cooling effect, however, this clearly will depend on the exact dimensions of the gap 34, the buoyancy of the cartridge 14 and the length of the container 12. Furthermore, as the inner wall section 26 of the container 12 is of a stainless steel having a relatively high thermal conductivity, heat transfer taking place between the cartridge 14 and the inner wall section 26 of the container, also provides for rapid cooling of the entire inner wall section 26 of the container. This in turn also enhances cooling of the liquid in the container above the cartridge due to heat transfer taking place not only between the liquid above the cartridge and the cartridge but also between an operative upper region of the inner wall section 26 of the container 12 and the liquid. The outer wall section of the container 12 clearly resists the transfer of heat between the inner wall section 26 of the container and the surrounding environment, thereby serving to maintain a liquid cooled within the container, at a relatively cool temperature.

The Applicant has found that relatively warmer liquid in the container 12, rises within the container. Accordingly, as the cartridge 14 rises within the container, this warmer liquid will be cooled by heat transfer taking place between the liquid and the cartridge. As such, warmer liquid will continue to be cooled by the cartridge 14 when the cartridge reaches its highest position within the container.

The Applicant believes that the liquid cooler of the invention provides an effective cooler that rapidly cools the liquid contained within the container and maintains the cool state of the liquid for relatively long periods of time.

What is claimed is:

1. A liquid cooler comprising:

a container comprising at least one surrounding wall of a material having relatively high thermal insulation characteristics, the surrounding wall defining an internal compartment for holding a liquid to be cooled and having an opening through which the liquid can be introduced into and removed from the internal compartment; and a buoyant cartridge comprising at least one surrounding wall defining an internal compartment for holding a relatively cool substance, the surrounding wall of the cartridge being of a material having a relatively high thermal conductivity and having dimensions and a configuration that permits it to be slidably accommodated in the container, whereby liquid to be cooled moves from a position above the cartridge to a position below the cartridge as the cartridge slidably rises in a buoyant manner.

2. A liquid cooler as claimed in claim 1, wherein the buoyant cartridge rises, in use, within the container when liquid to be cooled is container therein, thereby increasing the rate at which the liquid is cooled.

3. A liquid cooler as claimed in claim 2, wherein the cartridge has air captured therein to provide buoyancy therefor.

4. A liquid cooler as claimed in claim 1, wherein the surrounding wall of the container comprises an outer wall section of a material having relatively high thermal insulation characteristics and an inner wall section of a material having a relatively high thermal conductivity.

5. A liquid cooler as claimed in claim 4, wherein the opening of the container is releasably closeable by means of a closure that forms a fluid-tight seal with the container, in a closed condition of the closure.

6. A liquid cooler as claimed in claim 4, wherein the cartridge and the inner wall section of the surrounding wall of the container are of a stainless steel.

7. A liquid cooler comprising:

a container comprising at least one surrounding wall of a material having relatively high thermal insulation characteristics, the surrounding wall defining an internal compartment for holding a liquid to be cooled and having an opening through which the liquid can be introduced into and removed from the internal compartment;

a cartridge comprising at least one surrounding wall defining an internal compartment for holding a relatively cool substance, the surrounding wall of the cartridge being of a material having a relatively high thermal conductivity and having dimensions and a configuration that permits it to be accommodated in the container;

wherein the cartridge is buoyant, thereby permitting it to rise, in use, within the container when liquid to be cooled is contained therein, thereby increasing the rate at which the liquid is cooled; and wherein the container has an elongate configuration having two ends, with the surrounding wall thereof including a base wall at one end of the container and at least one side wall, the cartridge and the side wall of the container defining a space between them along which relative flow of a liquid to be cooled, occurs when the cartridge rises within the container, in use.

8. A liquid cooler comprising:

a container comprising at least one surrounding wall of a material having relatively high thermal insulation characteristics, the surrounding wall defining an internal compartment for holding a liquid to be cooled and having an opening through which the liquid can be introduced into and removed from the internal compartment;

a cartridge comprising at least one surrounding wall defining an internal compartment for holding a relatively cool substance, the surrounding wall of the cartridge bing of a material having a relatively high thermal conductivity and having dimensions and a configuration that permits it to be accommodated in the container;

wherein the cartridge is buoyant, thereby permitting it to rise, in use, within the container when liquid to be cooled is contained therein, thereby increasing the rate at which the liquid is cooled;

wherein the container has an elongate configuration having two ends, with the surrounding wall thereof including a base wall at one end of the container and at least one side wall, the cartridge and the side wall of the container defining a space between them along which relative flow of a liquid to be cooled, occurs when the cartridge rises within the container, in use; and wherein the space defined between the cartridge and the side wall of the container is sufficiently small to restrict the flow of liquid through the space and the buoyancy of the cartridge a predetermined amount, so as to cause the cartridge to rise within the container over an extended period of time.

9. A liquid cooler as claimed in claim 8, wherein the space defined between the cartridge and the side wall of the container when the cartridge rises, in use, within the container, is approximately 1 mm.

* * * * *